United States Patent [19]

Bobrowski

[11] Patent Number: 5,075,928

[45] Date of Patent: Dec. 31, 1991

[54] CONCEALED ARCHITECTURAL HINGE ASSEMBLY

[75] Inventor: Louis G. Bobrowski, Berlin, Conn.

[73] Assignee: The Stanley Works, New Brittain, Conn.

[21] Appl. No.: 570,168

[22] Filed: Aug. 17, 1990

[51] Int. Cl.[5] ..... E05D 7/00

[52] U.S. Cl. ..... 16/273; 16/374; 16/379; 16/382

[58] Field of Search ..... 16/273, 374, 378, 254, 16/379, 389, 376, 377, 390, 391, 392, 387, 382, 250; 49/388, 389

[56] References Cited

U.S. PATENT DOCUMENTS

| | | | |
|---|---|---|---|
| Re. 21,876 | 8/1941 | Tierney . | |
| 179,278 | 6/1876 | Cutler . | |
| 893,807 | 7/1908 | Mayhew . | |
| 984,034 | 2/1911 | Seipp . | |
| 1,073,316 | 9/1913 | Baldwin, Jr. . | |
| 1,094,010 | 4/1914 | Parsons . | |
| 1,114,026 | 10/1914 | Parsons | 16/379 |
| 1,164,857 | 12/1915 | Parsons . | |
| 1,228,257 | 5/1917 | Stuck . | |
| 1,338,260 | 4/1920 | Soss . | |
| 1,556,742 | 10/1925 | Anderson . | |
| 1,582,701 | 4/1926 | Soss . | |
| 1,602,754 | 10/1926 | Delbridge . | |
| 1,604,950 | 11/1926 | Anderson . | |
| 1,807,675 | 6/1931 | Suppes . | |
| 1,935,107 | 11/1933 | Bartimore . | |
| 1,948,775 | 2/1934 | Teller et al. . | |
| 1,961,022 | 5/1934 | Teller et al. . | |
| 2,032,630 | 3/1936 | Northup . | |
| 2,073,119 | 3/1937 | Phiel . | |
| 2,129,862 | 9/1938 | Naert . | |
| 2,132,266 | 10/1938 | LeFevre . | |
| 2,163,323 | 6/1939 | Howe . | |
| 2,175,577 | 10/1939 | Soss . | |
| 2,179,113 | 11/1939 | Bates . | |
| 2,201,490 | 5/1940 | Howe . | |
| 2,215,088 | 9/1940 | Soss . | |
| 2,217,937 | 10/1940 | Anderson . | |
| 2,284,320 | 5/1942 | Howe . | |
| 2,364,437 | 12/1944 | Gessler . | |
| 2,394,014 | 2/1946 | Schonitzer . | |
| 2,578,610 | 12/1951 | Stone . | |
| 2,648,870 | 8/1953 | Wilhelmi . | |
| 2,767,425 | 10/1956 | Bradley . | |
| 2,779,967 | 2/1957 | Braun . | |
| 3,066,349 | 12/1962 | Youngdale . | |
| 3,179,214 | 4/1965 | Hilfiker . | |
| 3,186,027 | 6/1965 | Merillat . | |
| 3,216,054 | 11/1965 | Cain . | |
| 3,564,771 | 2/1971 | Reynolds . | |
| 3,805,323 | 4/1974 | Fukui . | |
| 4,439,888 | 4/1984 | Merillat . | |
| 4,553,286 | 11/1985 | Schwarz, II | 16/254 |
| 4,583,261 | 4/1986 | Rock et al. . | |
| 4,807,331 | 2/1989 | Calucci | 16/382 |

*Primary Examiner*—Richard K. Seidel
*Assistant Examiner*—Edward A. Brown

[57] ABSTRACT

A concealable architectural hinge assembly has a mounting bracket with a U-shaped body which seats within a recess in the door jamb and a pair of flanges at its outer ends which extend along a face of the jamb. The mounting portion of one hinge leaf is secured to the bracket base wall and its knuckle portion is along its side edge in the direction of door opening movement, and it extends angularly outwardly to provide an offset barrel portion. The second hinge leaf has a generally U-shaped body with its mounting portion disposed against the edge of the door. It has a displacement or center portion which extends toward the other side edge of the first hinge leaf, and its arm portion extends substantially parallel to its mounting portion. The knuckle portion of the second leaf extends angularly from the plane of the arm position to provide an offset barrel portion aligned with that of the first leaf.

18 Claims, 3 Drawing Sheets

CONCEALED ARCHITECTURAL HINGE ASSEMBLY

BACKGROUND OF THE INVENTION

The present invention relates to hinges, and, more particularly, to architectural hinges which are substantially concealed when installed.

Various types of hinges are widely employed in connection with the mounting of doors on door frames. Depending upon the size and weight of the door, different hinges may be preferred for a given application. Other factors which bear upon hinge selection include the appearance, ease of installation and maintenance, and durability.

In certain installations, it is aesthetically desirable to conceal the hinge to the fullest extent feasible. In still other installations, it is desirable to mount the hinge so that, with the door closed, it is not accessible so as to permit an intruder to attempt to remove the hinge pins and thereby gain access to the building or room.

In most commercial and industrial applications, the doors employed are mounted in metal frames. Generally, these metal frames have hollow sections, and cutouts are provided in the jambs for the mounting of the hinges and for the mounting of the door latch elements. With such hollow metal frames, there are limitations upon the types of hinges which may be employed, and it is difficult to produce a rugged assembly in which conventional hinges are substantially concealed. Moreover, some heavy doors produce high loads at the hinge mounting areas of the jamb and it is desirable to reinforce the area in which the hinges are mounted.

It is an object of the present invention to provide a novel architectural hinge assembly which may be readily mounted on the jamb of a door frame to support a door.

It is also an object to provide such a hinge assembly which substantially conceals the hinge when the door is in the closed position.

Another object is to provide such a hinge assembly which permits movement of the door to an open position in which restriction of the the door opening is substantially avoided for easy passage of material and people therethrough, and which also includes means for limiting the amount of door opening movement to prevent undue forces upon the hinge and its mounting.

Still another object is to provide such a hinge assembly in which the components may be readily fabricated and assembled to provide a strong hinge mounting for relatively heavy doors.

SUMMARY OF THE INVENTION

It has been found that the foregoing and related objects may be readily attained in a concealable architectural hinge assembly which has a mounting bracket adapted to seat within a recess in the door jamb. The bracket has a generally U-shaped body portion defined by a base wall and end walls, and it has a pair of flanges at the outer ends of the end walls adapted to extend along a face of the door jamb. A first hinge leaf has a mounting portion disposed against the bracket base wall and a knuckle portion along the side edge of the mounting portion disposed in the direction of door opening movement, and this knuckle portion extends angularly outwardly from the mounting portion to provide an offset barrel portion.

A second hinge leaf has a generally U-shaped body with a mounting portion adapted to be seated against the edge of the door, a displacement portion extending along the side edge thereof toward the other side edge of the first hinge leaf, and an arm portion extending substantially parallel to the mounting portion of the second hinge leaf and adjacent the mounting portion of the first hinge leaf. The second hinge leaf has a knuckle portion at the end of the arm portion, and it extends angularly from the plane of the arm portion to provide an offset barrel portion aligned with that of the first hinge leaf.

Seated in the barrel portions of the hinge leaves is hinge pin means providing a pivotal connection therebetween. Disengageable fastening elements are provided for securing the first hinge leaf mounting portion to the base wall of the bracket and the second hinge leaf mounting portion to the associated door.

Preferably, the bracket also has inwardly projecting fingers at the outer ends of its end walls, and these provide stops against which the second hinge leaf abuts in the door open position of the hinge to limit its opening movement.

The mounting portion of the second hinge leaf has a multiplicity of apertures therein for seating the fastening elements. At least two of the apertures are aligned with the arm portion, and the arm portion has apertures therein which are aligned with the two apertures to facilitate access to the fastening elements by a screwdriver or like tool extending therethrough. The mounting portion of the first hinge leaf and the base wall of the bracket have aligned apertures therein for seating the fastening elements.

Desirably, the hinge includes bearing inserts in the barrel portions and in which the hinge pin means is rotatably seated.

The hinge assembly may also include a receptacle having a base wall, end walls, a side wall, and oppositely extending flanges at the ends of the end walls. The base walls, end walls and flanges of the bracket and receptacle are disposed in underlying relation, and the side wall is disposed inwardly of the hinge relative to the knuckle portions. The flanges of the receptacle are secured to the bracket, and the base wall of the receptacle has recesses therein into which the fastening elements for the first hinge leaf project.

Conveniently, the first hinge leaf has a single knuckle disposed intermediate its length and the second hinge leaf has a pair of knuckles between which the single knuckle is disposed. The barrel portion of the second hinge leaf extends from its extension arm at a lesser angle than that of the barrel portion of the first hinge leaf relative to its mounting portion.

The door assembly using these hinges has a door frame including a metal jamb having vertically spaced recesses in its face and adjacent its upper and lower ends. The door is mounted in the frame by the above described architectural hinge assemblies which are seated in the recesses and secured to the door.

DETAILED DESCRIPTION OF PREFERRED EMBODIMENT OF THE INVENTION

Figure 1:
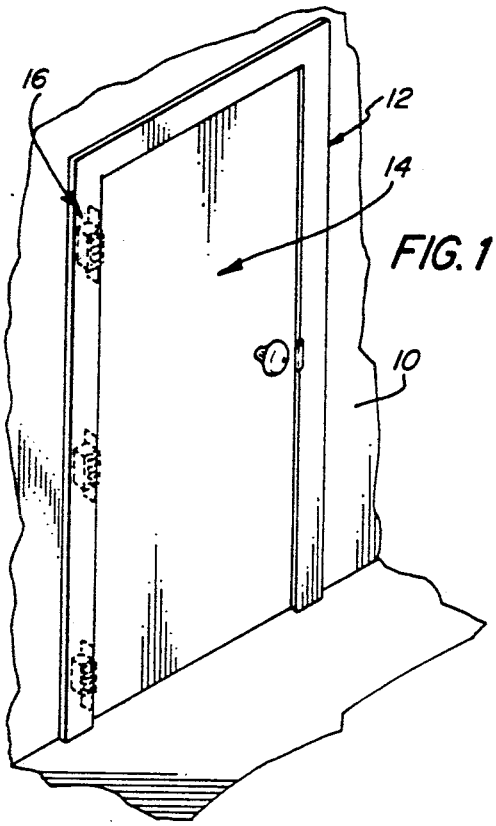
FIG. 1 is a fragmentary perspective view of a wall showing a door installation embodying the hinge assemblies of the present invention which are illustrated in phantom line.

Turning first to FIG. 1, therein illustrated is a typical door installation embodying the present invention in which a door opening in the wall 10 is framed by the metal door frame generally designated by the numeral 12, and the door 14 is supported for swinging movement relative to the frame by the hinge assemblies generally designated by the numeral 16 and illustrated in phantom line.

As seen in FIGS. 2, 3, 5 and 6, the hollow metal jamb 18 of the door frame 12 has a cutout in its face which provides a recess within the jamb 18 in which is mounted the hinge assembly 16 of the present invention.

Figure 4:
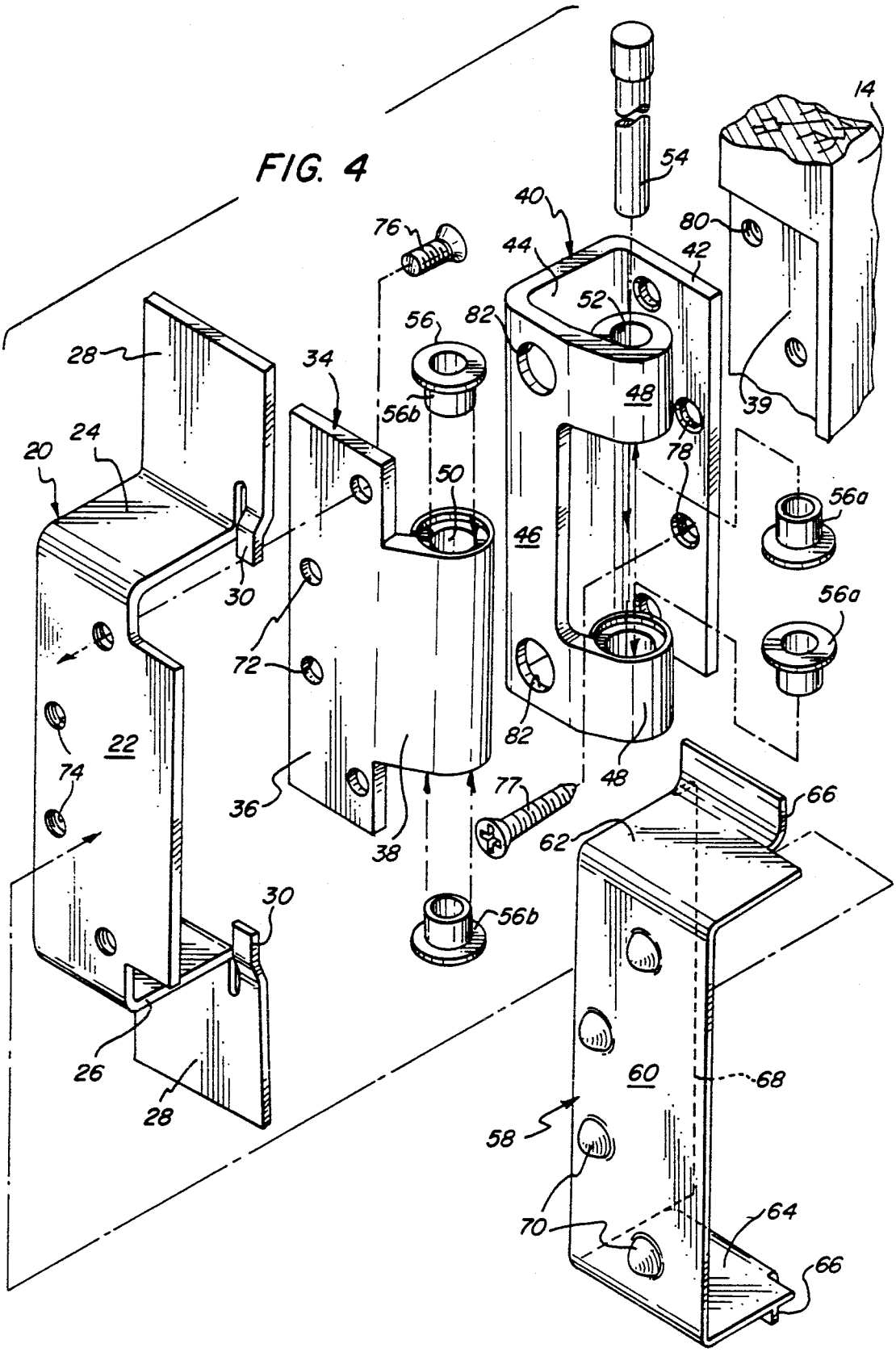
FIG. 4 is an exploded view of a hinge assembly employed in the door installation of FIG. 1 with a portion of the door fragmentarily illustrated.

The general structure of the hinge assembly of the present invention is best seen in FIG. 4. A U-shaped bracket generally designated by the numeral 20 is defined by the vertically extending base wall 22, and the top and bottom end walls 24 and 26, and it has flanges 28 which extend along the inside surface of the face of the jamb 18. The flanges 28 also have inwardly extending offset fingers 30 at their edges adjacent the direction of door opening movement. In the illustrated embodiment, the flanges 28 are welded to the inside surface of the jamb 18 as indicated by the weld lines 32 seen in FIG. 2.

Disposed within the bracket 20 is the first hinge leaf generally designated by the numeral 34 and including the mounting portion 36 and its angularly offset knuckle portion 38.

Mounted in a mortised recess 39 in the edge of the door 14 is the second hinge leaf generally designated by the numeral 40. It has a generally U-shaped body with a mounting portion 42 seated in the mortised recess 39, an extension portion 44 extending from the inner edge of the mounting portion 42 towards the other hinge leaf 34, and an arm portion 46 which supports at its end the angularly offset knuckle portions 48.

Seated within the barrels 50, 52 of the knuckle portions 38, 48 is a hinge pin 54 to provide the pivotal connection therebetween. To reduce friction, bearing inserts 56*a* of stainless steel and bearing inserts 56*b* of synthetic resin providing a low coefficient of friction are inserted into the barrels 50, 52 and actually support the hinge pin 54.

Figure 2:
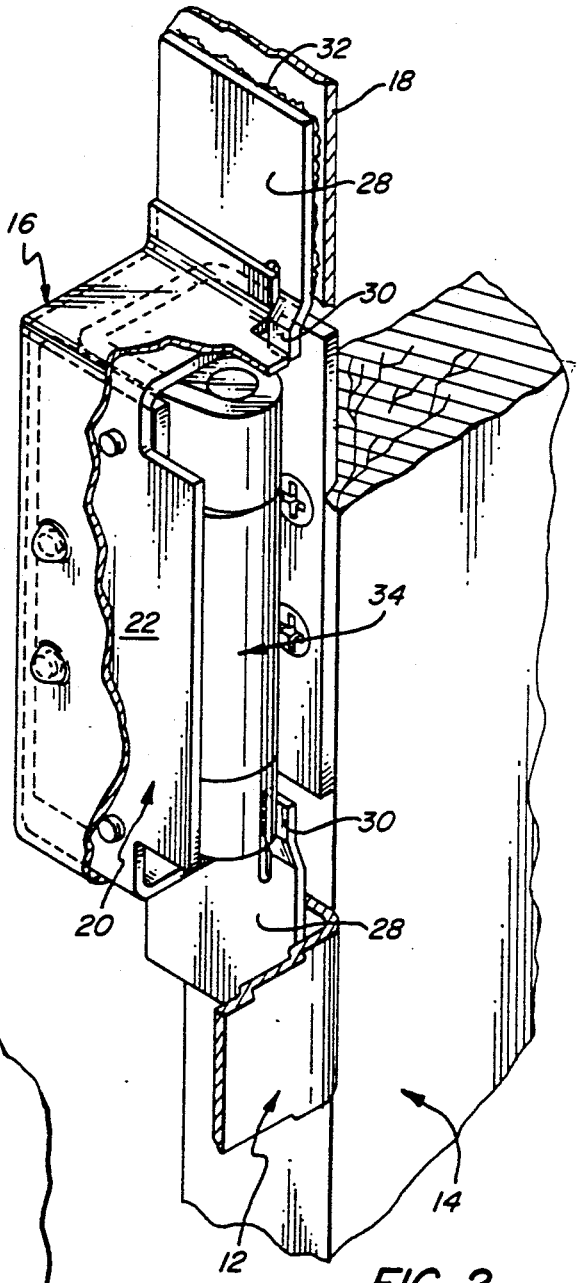
FIG. 2 is a fragmentary perspective view to an enlarged scale of the door installation of FIG. 1 with portions of the door and jamb broken away to reveal the construction of the hinge assembly as mounted within the fragmentarily illustrated jamb.
Figure 3:
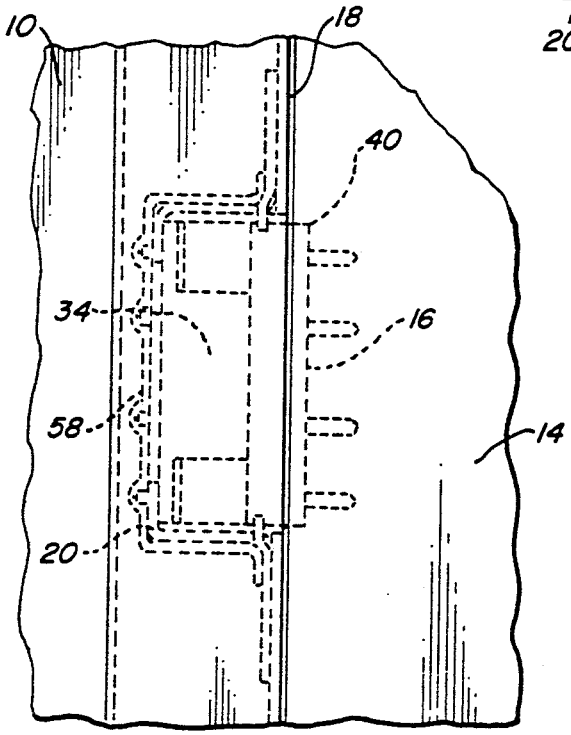
FIG. 3 is a fragmentary front elevational view of the door assembly of FIG. 1 drawn to an enlarged scale and showing in phantom one of the hinge assemblies.

Substantially enclosing the bracket 20 is a receptacle generally designated by the numeral 58, and it has a base wall 60 and top and bottom end walls 62, 64 with relatively short outwardly extending flanges 66 which are welded to the inside surface of the bracket flanges 28 as seen in FIG. 2. The receptacle 58 also has a side wall 68 along the side spaced from the direction of door opening movement. The base wall 60 of the enclosure 58 has a multiplicity of dimples or recesses 70 formed in alignment with the mounting apertures 72, 74 in the hinge leaf 34 and the bracket 20 respectively, and the threaded fasteners 76 extend through such apertures and thereinto.

The hinge leaf 40 also has mounting apertures 78 therein and wood fasteners 77 extend therethrough and into the holes 80 in the edge of the door 14.

As may be seen, the arm portion 46 of the second hinge leaf 40 has a pair of relatively large diameter apertures 82 which are aligned with the mounting apertures 78.

As previously indicated, the bracket 20 is initially assembled to the door jamb 18, most conveniently by tack welding the flanges 28 as indicated by the weld lines 32 in FIG. 2. Moreover, the bracket 20 is secured to the inside face of the jamb 18 in order to permit the edge of the door 14 to be spaced closely to the face of the jamb 18 in the closed position. Alternatively, the jamb may be stamped or otherwise formed to form a recess in its outer face for seating the flanges 28, or a larger gap can be tolerated if so desired. Although welding is the preferred method for assembling the bracket 20 to the jamb 18, screws or other threaded fasteners may be utilized to effect its mounting.

In the preferred embodiment of the present invention, the receptacle 58 is welded to the bracket 20 prior to its mounting upon the jamb 18. However, fasteners may also be employed to effect engagement between its flanges 66 and the flanges 28 of the bracket 20.

Although the bracket and hinge may be mounted on the jamb 18 after the hinge has been secured to the door 14, it is generally more convenient to assemble the bracket 20 onto the jamb 18 and thereafter fasten the first hinge leaf 34 to the bracket 20 after the hinge has been mounted on the door 14. As seen, there are four mounting apertures 74 in the bracket into which the machine screws 76 will be threaded after first passing through the apertures 72 in the mounting portion 36 of the hinge leaf 34.

In assembling the hinge leaf 40 in the mortised recess 39 of the door 14, it will be appreciated that the inner two of the mounting apertures 78 would normally be within the shadow of the solid portion of the arm portion 46 and thus require either a right angle screwdriver or some other device in order to be able to insert and drive the fasteners 76 through the innermost mounting apertures 78 into the mounting apertures 80 in the door 14. The large access apertures 82 provided in the arm portion 46 enable a screwdriver or like tool to have its shank passed therethrough so as to permit direct axial engagement of the head of the fasteners 76 to facilitate alignment and firm tightening of the fasteners 76 into the apertures in the door 14. The other apertures 78 are accessible through the opening between the elements of the knuckle portion 48. It will also be appreciated that the access apertures 82 enable the use of relatively long wood screws which otherwise might be difficult to insert and tighten because of the limited spacing between the mounting portion 42 and the arm portion 46.

When the fasteners 76 are threaded into the apertures 74 of the bracket, it will be appreciated that the shank portions extend beyond the thickness of the base wall 22 of the bracket 20 and into the recesses provided by the dimples 70 to ensure firm engagement of the hinge leaf 34 to the bracket 20.

After the hinge leaf 40 has been mounted on the edge of the door 14, it is assembled to the leaf 34 by the pins 54 which are inserted downwardly thereinto and firmly engaged within the synthetic resin bearing inserts 56.

The door 14 with the hinges thereon is moved into alignment with the brackets 20 and the mounting apertures 72 aligned with the apertures 74. The fasteners 76 are then inserted to secure the door 14 into the jamb 18.

Figure 5:
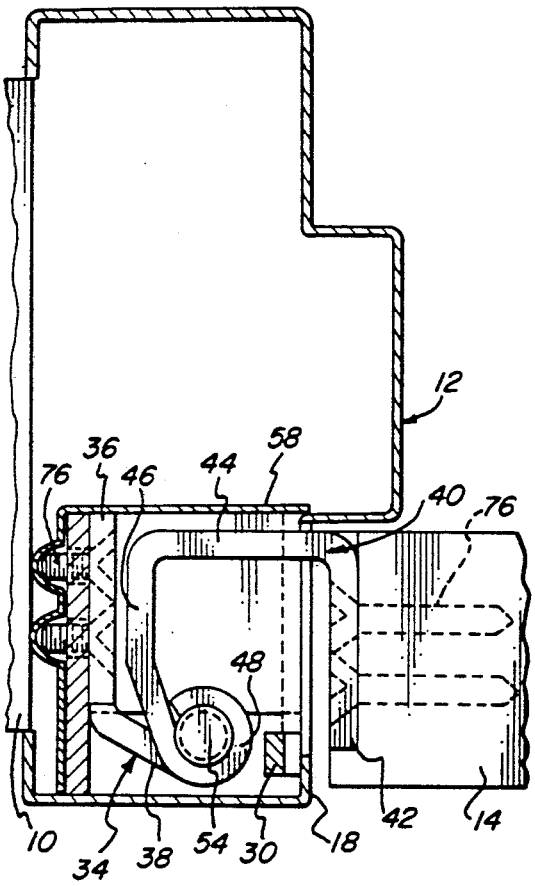
FIG. 5 is a fragmentary transverse sectional view of the door installation in FIG. 1.
Figure 6:
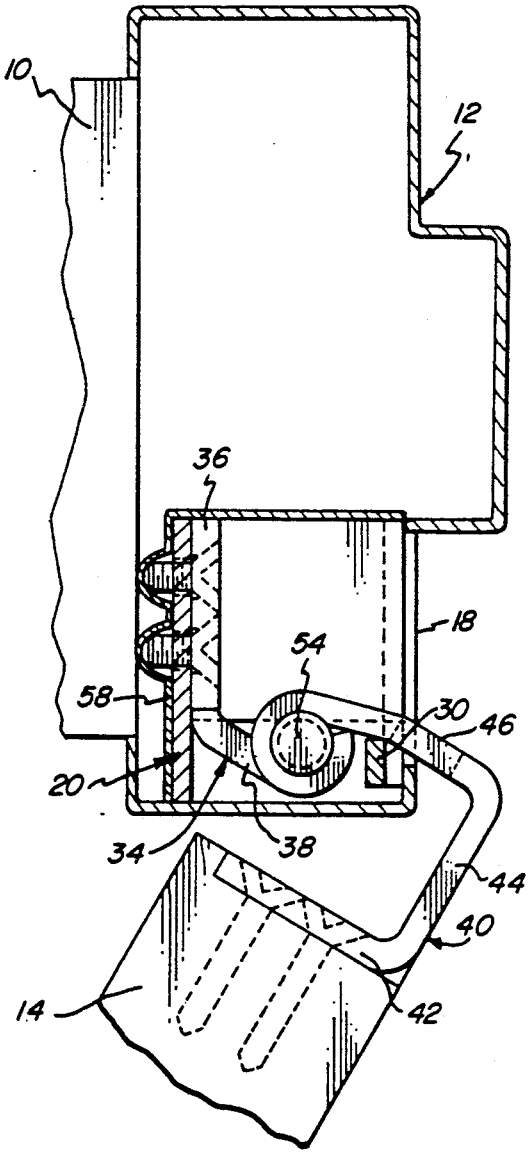
FIG. 6 is a similar view with the door shown in its full open position.

Turning now to FIGS. 5 and 6, it can be seen that the gap between the edge of the door 14 and the face of the jamb 18 is relatively small with the door 14 in the closed position. The only portion of the hinge which is visible in the closed position is a small length of the extension portion 44.

When the door is rotated approximately 120° to its open position, further motion is stopped by abutment of the arm portion 46 against the offset fingers 30 of the bracket which function as stops. Thus, the door 14 is able to swing into a position in which it is disposed substantially to the outside of the door opening as defined by the stop on the jamb 18, but the fingers 30 preclude the hinge leaf 40 from contacting the jamb 18 when fully open and thus damaging the lighter gauge jamb 18. Moreover, the fingers 30 not only limit the strain on the hinge itself, but also prevent the door from banging into adjacent walls or furniture which may be disposed adjacent the door opening.

The enclosure 58 is desirable because not only does it add to the rigidity of the assembly, but also, and more importantly, it provides an enclosure for the fasteners 76 and the elements of the hinge received within the bracket 20 to minimize the amount of grout, dust and the like which might otherwise contaminate the hinge and its components by entering from the space within the wall.

It will be appreciated that modifications of the several elements from those specifically illustrated and described may be made without departing from the spirit of the invention. Although the hinge assemblies of the present invention are most readily applied to door installations utilizing metal frames, they could be utilized in connection with wooden door frames provided that the jambs are provided with mortised recesses or constructed from multiple pieces in order to accept the bracket which comprises a significant part of the assembly. Metal and plastic skin doors may also be employed by providing mounting areas for the hinge.

Thus, it can be seen from the foregoing detailed specification and attached drawing that the hinge assembly of the present invention is one which may be fabricated readily and economically from relatively strong components to provide a durable hinge capable of carrying relatively heavy doors. The hinge assemblies are substantially concealed when properly mounted in the door frame, and the hinge pins are protected from removal when the door is in the closed position. The resultant door assemblies are attractive as well as long lived, and the opening through the doorway is substantially unrestricted by the door when it is in its opened position.

Having thus described the invention, what is claimed is:

1. A concealable architectural hinge assembly comprising:

(a) a mounting bracket adapted to seat within a recess in an associated door jamb having a generally U-shaped body portion defined by a base wall, end walls and a pair of flanges at outer ends of said end walls extending substantially parallel to said base wall and adapted to extend along a face of the associated door jamb;

(b) a first hinge leaf having a mounting portion disposed against said mounting bracket base wall and a knuckle Portion along a side edge of said mounting portion disposed in the direction of door opening movement, said knuckle portion extending angularly outwardly from said mounting portion to provide an offset barrel portion;

(c) a second hinge leaf having a generally U-shaped body with a mounting portion adapted to be seated against an edge of an associated door, a displacement portion extending along a side edge thereof toward the other side edge of said first hinge leaf, and an arm portion extending substantially parallel to said mounting portion of said second hinge leaf and adjacent said mounting portion of said first hinge leaf, said second hinge leaf also having a knuckle portion at the edge of said arm portion spaced from said displacement portion, said arm portion extending angularly from the plane of said arm portion to provide an offset barrel portion aligned with that of said first hinge leaf;

(d) hinge pin means seated in said barrel portions of said hinge leaves and providing a pivotal connection therebetween; and (e) disengageable fastening elements for securing said first hinge leaf mounting portion to said base wall of said bracket and said second hinge leaf mounting portion to the associated door.

2. The concealable architectural hinge assembly in accordance with claim 1 wherein said bracket also has inwardly projecting fingers on said flanges providing stops against which said second hinge leaf abuts in the full door open position of said hinge to limit opening movement.

3. The concealable architectural hinge assembly in accordance with claim 1 wherein said mounting portion of said second hinge leaf has a multiplicity of apertures therein for seating said fastening elements, at least two of said apertures being aligned with said arm portion, said arm portion having apertures therein aligned with said at least two apertures to facilitate mounting said fastening elements by a screwdriver or like tool extending therethrough.

4. The concealable architectural hinge assembly in accordance with claim 1 wherein said mounting portion of said first hinge leaf and said base wall of said bracket have aligned apertures therein for seating said fastening elements.

5. The concealable architectural hinge assembly in accordance with claim 1 wherein said hinge includes bearing inserts in said barrel portions and in which said hinge pin means is rotatably seated.

6. The concealable architectural hinge assembly in accordance, with claim 1 wherein said hinge also includes a receptacle having a base wall, end walls, one side wall and oppositely extending flanges at the ends of said end walls extending substantially parallel to said base wall, said first hinge leaf being substantially seated within said receptacle, said base walls, end walls and flanges of said bracket and receptacle being disposed in underlying relation and said side wall being disposed inwardly of said hinge relative to said knuckle portions, said flanges of said receptacle being secured to said bracket.

7. The concealable architectural hinge assembly in accordance with claim 6 wherein said base wall of said receptacle has recesses therein into which the fastening elements for said first hinge leaf project.

8. The concealable architectural hinge assembly in accordance with claim 1 wherein said first hinge leaf has a single knuckle disposed intermediate its length and said second hinge leaf has a pair of knuckles between which said single knuckle is disposed.

9. The concealable architectural hinge assembly in accordance with claim 1 wherein said barrel portion of said second hinge leaf extends from its extension arm at a lesser angle than that of said barrel portion of said first hinge leaf relative to its mounting portion.

10. A door assembly comprising:

(a) a door frame including a jamb having vertically spaced recesses in its face adjacent its upper and lower ends;

(b) a door mounted in said frame;

(c) concealed architectural hinges each comprising (i) a mounting bracket having a generally U-shaped body portion defined by a base wall and end walls seated within said recesses in said jamb and a pair of flanges at the outer ends of the end walls extending along a face of said jamb (ii) a first hinge leaf having a mounting portion disposed against said bracket base wall and a knuckle portion along a side edge of said mounting portion disposed in the direction of door opening movement, said knuckle portion extending angularly outwardly from said mounting portion to provide an offset barrel portion (iii) a second hinge leaf having a generally U-shaped body with a mounting portion seated against the adjacent edge of said door, a displacement portion extending along a side edge thereof toward the other side edge of said first hinge leaf, and an arm portion extending substantially parallel to said mounting portion of said second hinge leaf and adjacent said mounting portion of said first hinge leaf, said second hinge leaf also having a knuckle portion at the edge of said arm portion spaced from said displacement portion, said arm portion extending angularly from the plane of said arm portion to provide an offset barrel portion aligned with that of said first hinge leaf (iv) hinge pin means seated in the barrel portions of said hinge leaves and providing a pivotal connection therebetween (v) disengageable fastening elements securing said first hinge leaf mounting portion to said base wall of said bracket and said second hinge leaf mounting portion to said edge of said door.

11. The door assembly in accordance with claim 10 wherein said bracket also has inwardly projecting fingers on said flanges providing stops against which said second hinge leaf abuts in the door open position of said hinge to limit opening movement.

12. The door assembly in accordance with claim 10 wherein said mounting portion of said second hinge leaf has a multiplicity of apertures therein seating said fastening elements, at least two of said apertures being aligned with said arm portion, said arm portion having apertures therein aligned with said at least two apertures to facilitate access to said fastening elements by a screwdriver or like tool extending therethrough.

13. The door assembly in accordance with claim 10 wherein said mounting portion of said first hinge leaf and said base wall of said bracket have aligned apertures therein seating said fastening elements.

14. The door assembly in accordance with claim 10 wherein said hinge includes bearing inserts in said barrel portions and in which said hinge pin means is rotatably seated.

15. The door assembly in accordance with claim 10 wherein said hinge also includes a receptacle having a base wall, end walls, one side wall and oppositely extending flanges at the ends of said end walls extending substantially parallel to said base wall, said first hinge leaf being substantially seated within said receptacle, said base wall, end walls and flanges of said bracket and receptacle being disposed in underlying relation and said side wall being disposed inwardly of said hinge relative to said knuckle portions, said flanges of said receptacle being secured to said bracket.

16. The door assembly in accordance with claim 15 wherein said base wall of said receptacle has recesses therein into which the fastening elements for said first hinge leaf project.

17. The door assembly in accordance with claim 10 wherein said first hinge leaf has a single knuckle disposed intermediate its length and said second hinge leaf has a pair of knuckles between which said single knuckle is disposed.

18. The door assembly in accordance with claim 10 wherein said barrel portion of said second hinge leaf extends from its extension arm at a lesser angle than that of said barrel portion of said first hinge leaf relative to its mounting portion.

* * * * *